US006719913B2

(12) United States Patent
Conta et al.

(10) Patent No.: US 6,719,913 B2
(45) Date of Patent: Apr. 13, 2004

(54) PRINTHEAD WITH MULTIPLE INK FEEDING CHANNELS

(75) Inventors: Renato Conta, Ivrea (IT); Alessandro Scardovi, Ivrea (IT)

(73) Assignee: Olivetti Tecnost S.p.A. (IT)

( * ) Notice: Subject to any disclaimer, the term of this patent is extended or adjusted under 35 U.S.C. 154(b) by 0 days.

(21) Appl. No.: 10/169,114

(22) PCT Filed: Dec. 19, 2000

(86) PCT No.: PCT/IT00/00534

§ 371 (c)(1),
(2), (4) Date: Jun. 27, 2002

(87) PCT Pub. No.: WO01/47715

PCT Pub. Date: Jul. 5, 2001

(65) Prior Publication Data

US 2003/0061987 A1 Apr. 3, 2003

(30) Foreign Application Priority Data

Dec. 27, 1999 (IT) ..... AO99A0002

(51) Int. Cl.[7] ..... B41J 2/16
(52) U.S. Cl. ..... 216/27
(58) Field of Search ..... 216/27

(56) References Cited

U.S. PATENT DOCUMENTS

| | | | | |
|---|---|---|---|---|
| 4,502,060 A | | 2/1985 | Rankin et al. | |
| 5,734,399 A | | 3/1998 | Weber et al. | |
| 6,019,907 A | * | 2/2000 | Kawamura | 216/27 |
| 6,117,698 A | * | 9/2000 | Atobe et al. | 438/21 |
| 6,162,589 A | * | 12/2000 | Chen et al. | 430/320 |
| 6,309,054 B1 | * | 10/2001 | Kawamura et al. | 347/65 |
| 6,365,058 B1 | * | 4/2002 | Beatty et al. | 216/27 |

FOREIGN PATENT DOCUMENTS

| | | |
|---|---|---|
| EP | 0549211 A1 | 6/1993 |
| EP | 0564069 A2 | 10/1993 |
| EP | 0678387 A3 | 10/1995 |
| EP | 0694398 A1 | 1/1996 |

* cited by examiner

*Primary Examiner*—Anita Alanko
(74) *Attorney, Agent, or Firm*—Banner & Witcoff, Ltd.

(57) ABSTRACT

A thermal ink jet printhead (40) for the emission of droplets of ink on a print medium (46) comprises a reservoir (103) containing ink (142), a die (61), a slot (102) engraved in said die (61) and a plurality of ejectors (73), each of which in turn comprises a chamber (74), a resistor (27) and a nozzle (56), each of said chambers (74) being put in fluid communication with said slot (102) through a plurality of elementary ducts (72) lying on a different plane from the bottom (67) of said chamber (74).

2 Claims, 14 Drawing Sheets

Related Art

Related Art

PRINTHEAD WITH MULTIPLE INK FEEDING CHANNELS

This application is a U.S. national phase application of PCT/IT00/00534, filed Dec. 19, 2000, claiming priority on Italian Application No. A099A000002, filed Dec. 27, 1999, herein incorporated by reference.

TECHNICAL FIELD

This invention relates to a printhead used in equipment for forming, through successive scanning operations, black and colour images on a print medium, usually though not exclusively a sheet of paper, by means of the thermal type ink jet technology, and in particular to the head actuating assembly and the associated manufacturing process.

BACKGROUND ART

Depicted in FIG. 1 is an ink jet colour printer on which the main parts are labelled as follows: a fixed structure 41, a scanning carriage 42, an encoder 44 and, by way of example, printheads 40 which may be either monochromatic or colour, and variable in number.

The printer may be a stand-alone product, or be part of a photocopier, of a "plotter", of a facsimile machine, of a machine for the reproduction of photographs and the like. The printing is effected on a physical medium 46, normally consisting of a sheet of paper, or a sheet of plastic, fabric or similar.

Also shown in FIG. 1 are the axes of reference:

x axis: horizontal, i.e. parallel to the scanning direction of the carriage 42; y axis: vertical, i.e. parallel to the direction of motion of the medium 46 during the line feed function; z axis: perpendicular to the x and y axes, i.e. substantially parallel to the direction of emission of the droplets of ink.

The composition and general mode of operation of a printhead according to the thermal type technology, and of the "top-shooter" type in particular, i.e. those that emit the ink droplets in a direction perpendicular to the actuating assembly, are already widely known in the sector art, and will not therefore be discussed in detail herein, this description instead dwelling more fully on some only of the features of the heads and the manufacturing process, of relevance for the purposes of understanding this invention.

The current technological trend in ink jet printheads is to produce a large number of nozzles per head (≧300), a definition of more than 600 dpi (dpi="dots per inch"), a high working frequency (≧10 kHz) and smaller droplets (≦10 pl) than those produced in earlier technologies.

Requirements such as these are especially important in colour printhead manufacture and make it necessary to produce actuators and hydraulic circuits of increasingly smaller dimensions, greater levels of precision, narrow assembly tolerances. It is important in particular to ensure that the volume and speed of the droplets subsequently emitted are as constant as possible, and that no "satellite" droplets are formed as these, with a trajectory generally different from the main droplets, are distributed randomly near the edges of the graphic symbols, reducing their sharpness.

FIG. 2 shows an enlarged axonometric view of an actuating assembly 111 of an ink jet printhead according to the known art, made of a die 100 of semiconductor material (usually Silicon), on the upper face of which resistors 27 have been made for emission of the droplets of ink, driving circuits 62 for driving the resistors 27, soldering pads 77 for connecting the head to an electronic controller not shown in the figure, and which bears a pass-through slot 102 through which the ink flows from a reservoir not shown in the figure. Around the upper edge of the slot 102 a basin 76 has been made, the characteristics and functions of which are as described in detail in Italian patent application TO 98A 000562. Affixed to the upper face of the die is a layer 105 of photopolymer having, usually though not exclusively, a thickness less than or equal to 25 $\mu$m in which, by means of known photolithographic techniques, a plurality of ducts 53 and a plurality of chambers 57 positioned locally to the resistors 27 have been made. Stuck on the photopolymer 105 is a nozzle plate 106, generally made of a plate of gold-plated nickel or kapton, of thickness less than or equal to 50 $\mu$m, bearing a plurality of nozzles 56, each nozzle 56 being in correspondence with a chamber 57. In the current technology, the nozzles 56 have a diameter D of between 10 and 60 $\mu$m, while their centres are usually spaced apart by a pitch A of $1/300^{th}$ or $1/600^{th}$ of an inch (84.6 $\mu$m or 42.3 $\mu$m). Generally, though not always, the nozzles 56 are arranged in two rows parallel to the y axis, staggered one from the other by a distance B=A/2, in order to double the resolution of the image in the direction parallel to the y axis; the resolution thus becomes $1/600^{th}$ or $1/1200^{th}$ of an inch (42.3 $\mu$m or 21.2 $\mu$m). The x, y and z axes, already defined in FIG. 1, are also shown in FIG. 2.

FIG. 3 is an axonometric enlargement of two chambers 57, adjacent and communicating with the slot 102 through the basin 76 and the ducts 53 made in the layer of photopolymer 105. Normally the ducts 53 have a length l and a rectangular cross-section having a depth a and a width b. The chambers 57 have a depth d, substantially equal to the depth a of the ducts 53.

A section of an ejector 55 can be seen in FIG. 4, where the following are shown, in addition to the items already mentioned: a reservoir 103 containing ink 142, a droplet 51 of ink, a vapour bubble 65, a meniscus 54 in correspondence with the surface of separation between the ink and the air, an external edge 66 and arrows 52 which indicate the prevalent direction of motion of the ink.

To describe the operation of an ejector for a thermal type ink jet printhead, an electrical analogy is used, for which the following equivalences are established:

| | |
|---|---|
| V = electrical voltage in volt | equivalent to: pressure in $N/m^2$; |
| I = current in A | equivalent to: flow rate $m^3/s$; |
| R = resistance in ohm | equivalent to: hydraulic resistance in $N/m^2/m^3/s = N\ s/m^5$; |
| L = Inductance in henry | equivalent to the ratio between the mass of the column of liquid that fills the duct and the square of the section of the duct; this ratio is called "hydraulic inertance", and is measured in $kg/m^4$; |
| C = capacitance in farad | equivalent to: hydraulic compliance in $m^3/N/m^2 = m^5/N$. |

In the equivalent diagram of FIG. 5 the bubble is represented as a variable capacitance $C_b$. There is a front leg 70, equivalent to the whole formed by the chamber 57, the nozzle 56, the meniscus 54 and the droplet 51, and a rear leg 71, which represents the section of the hydraulic circuit between the chamber 57 and the reservoir 103.

The front leg 70 comprises a fixed impedance $L_f$, $R_f$ corresponding substantially to the chamber 57, a variable impedance $L_u$, $R_u$ corresponding substantially to the nozzle 56, and a deviator T which, during the step in which the droplet 51 is formed, inserts a variable resistance $R_g$ substantially corresponding to the droplet, whereas, during the steps of withdrawal of the meniscus 54, of filling of the nozzle, of subsequent oscillation and damping of the meniscus, inserts a capacitance $C_m$ substantially corresponding to the meniscus itself.

Ejection of the ink takes places in accordance with the following steps:

a) The electronic control circuit 62 supplies energy to the resistor 27, so as to produce local boiling of the ink with formation of the bubble 65 of steam in expansion. During this step, in the equivalent electric circuit of FIG. 5 the variable resistance $R_g$ is inserted. The bubble 65 generates two opposing flows: $I_p$ (to the reservoir 103) and $I_a$ (to the nozzle 56).

b) The electronic circuit 62 terminates the delivery of energy to the resistor 27, the vapour condenses, the bubble 65 collapses, the droplet 51 detaches itself, the meniscus 54 withdraws emptying the nozzle 56. The two opposing flows $I_p$ and $I_a$ remain. In this step, in the equivalent circuit of FIG. 5 the capacitance $C_m$ corresponding to the meniscus 54 is inserted.

c) The bubble 65 has disappeared, the meniscus 54 demonstrates its capillarity and goes back towards the outer edge 66 of the nozzle 56 sucking new ink 142 into the nozzle 56. Its return completed, the meniscus 54 remains attached to the outer edge 66 by oscillating and behaving like a vibrating membrane. In the equivalent electric circuit of FIG. 5 the capacitance $C_m$ is still inserted. During this step the equivalent circuit of the ejector 55 is simplified as sketched in FIG. 6, where $C_m$ represents the capacitance of the meniscus, while R and L represent respectively the sum of all the resistances and of all the inductances present between the meniscus 54 and the reservoir 103. In addition, the flows $I_p$ and $I_a$ converge into a single flow i.

To obtain an optimal operation of the ejector 55, it is necessary for the meniscus 54, at the end of the step c), to reach the idle state rapidly and without oscillating. In this way the ink 142 does not wet the outer surface of the nozzle plate 106, thereby avoiding alterations of speed and volume of the following droplets.

For a given nozzle 56 the parameters $L_u$, $R_u$ and $C_m$, belonging to the front hydraulic part 70 of the ejector 55, are set and therefore, to obtain the values of R and L according to the criteria set down below, it is possible to act only on the design of the rear hydraulic part 71.

The expression in function of the time i, which represents the flow, is given by the known relation:

$$i = \frac{V_m}{L} * t * e^{\frac{-t}{2\tau}} \tag{1}$$

where $V_m$ represents the pressure generated by the meniscus 54, which is negative during the filling step, and τ is the time constant, measured in seconds, of the RLC circuit of FIG. 6, equal to the ratio L/R.

For maximum speed in filling of the nozzle 56, the flow i must be rendered maximal, and for this to happen L and τ must be rendered minimal.

Also, for the meniscus 54 to reach the idle state rapidly without oscillating, the equivalent circuit of FIG. 6 must be "critical damping" type, and must for this purpose satisfy the known relation:

$$R = 2 * \sqrt{\frac{L}{C_m}} \tag{2}$$

For a duct 53 of length l, the section of which has sides a and b with a>>b, the following known relations apply:

$$R \cong \frac{12 * \rho * \upsilon * l}{b^3 * a} \tag{3}$$

$$L \cong \frac{\rho * l}{b * a} \tag{4}$$

$$\tau = \frac{L}{R} = \frac{b^2}{12 * \upsilon} \tag{5}$$

where ρ is the density of the ink in $kg/m^3$, ν is the viscosity of the ink in $m^2/s$, and all lengths are measured in metres.

The time constant τ is a function of the width b, while it is independent of both the depth a and the length l.

It is possible to determine a value of b which gives values R and L such as to produce the critical damping, according to the expression (2). However the same value of b, substituted in (5), provides a value of τ which limits the flow i, according to the relation (1), and accordingly limits the emission frequency of the droplets. Moreover, it is not possible to modify either depth a or length l at will, as these parameters are subject to other technological and functional constraints, not described as they are not essential for the understanding of this invention.

To increase the emission frequency of the droplets, it is necessary to make the time constant τ much shorter than that obtained in the known art, while at the same time satisfying the critical damping condition: this problem is solved in this invention by making a plurality of N ducts in parallel, as will be seen in detail in the description of the preferred embodiment.

Some further drawbacks with the chambers 57 according to the known art are now mentioned, which have three continuous lateral walls and a fourth wall interrupted by the duct 53 of non-negligible width. In this situation the bubble 65 collapses prevalently in the direction of the resistor 27 underneath, which is thus subjected to greater wear on account of the known phenomenon of cavitation. In addition, the collapse of the bubble is dissymmetrical as it is attracted to the wall opposite the duct 53: this cause a dissymmetry in the motion of the meniscus 54, with a resulting deviation of the terminal part of the droplet 51 and the formation of satellite droplets having a different direction from the droplet 51.

In this invention the duct 53 is substituted by N ducts placed in parallel and communicating with the chamber through the lower or upper wall, and consequently the four lateral walls of the chamber are continuous and symmetrical.

In U.S. Pat. No. 5,666,143 a solution is described in which the ink is brought to the chamber along multiple ducts, but these do not suffice to solve the problems reported.

DISCLOSURE OF THE INVENTION

The object of this invention is to render the emission frequency of the droplets of ink maximal by making the time constant τ of the ejector as short as possible, while at the same time satisfying the condition of critical damping of the meniscus.

Another object is to increase the degrees of freedom of the design of the ejector, by having the additional parameter consisting of the number N of elementary ducts in parallel.

A further object is to increase the life span of the resistor by making a chamber with four continuous walls, which promotes symmetrical collapse of the bubble in the direction of these walls and not towards resistor: this lowers the harmful effects of cavitation during collapse of the bubble.

Another object is to avoid the formation of satellite droplets by achieving a symmetrical movement of the meniscus made possible by the chamber with four continuous walls.

Yet another object is to filter the ink of any impurities that may be present.

These and other objects, characteristics and advantages of the invention will be apparent from the description that follows of a preferred embodiment, provided purely by way of an illustrative, non-restrictive example, with reference to the accompanying drawings.

Figure 15:
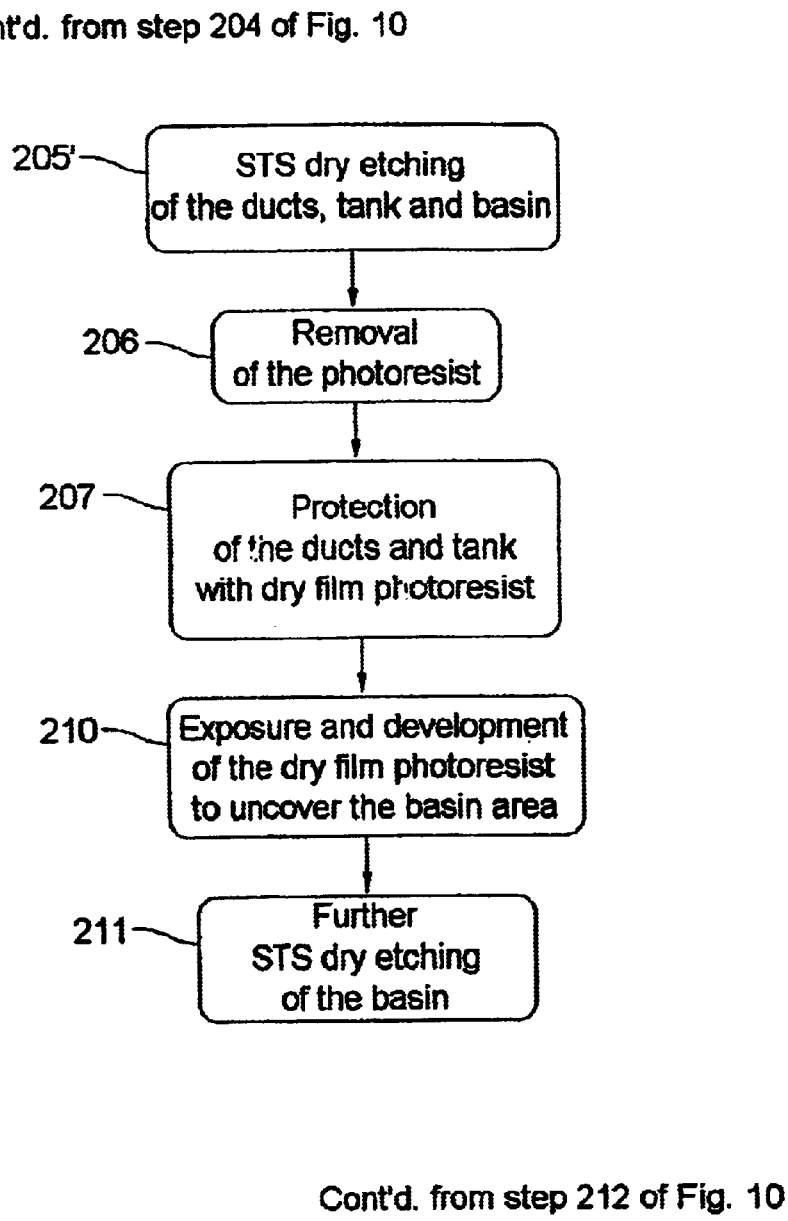
Figure 16:
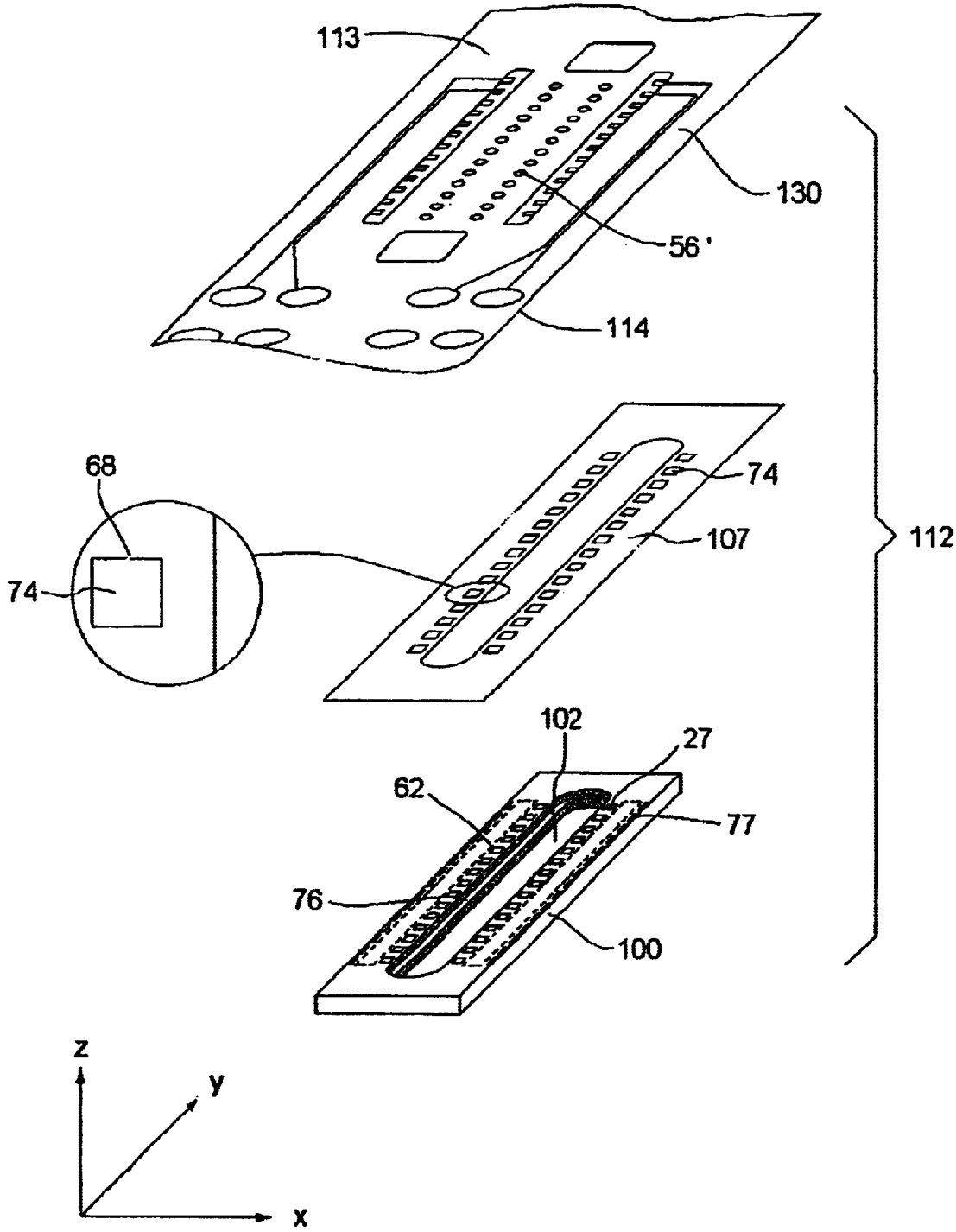
Figure 17:
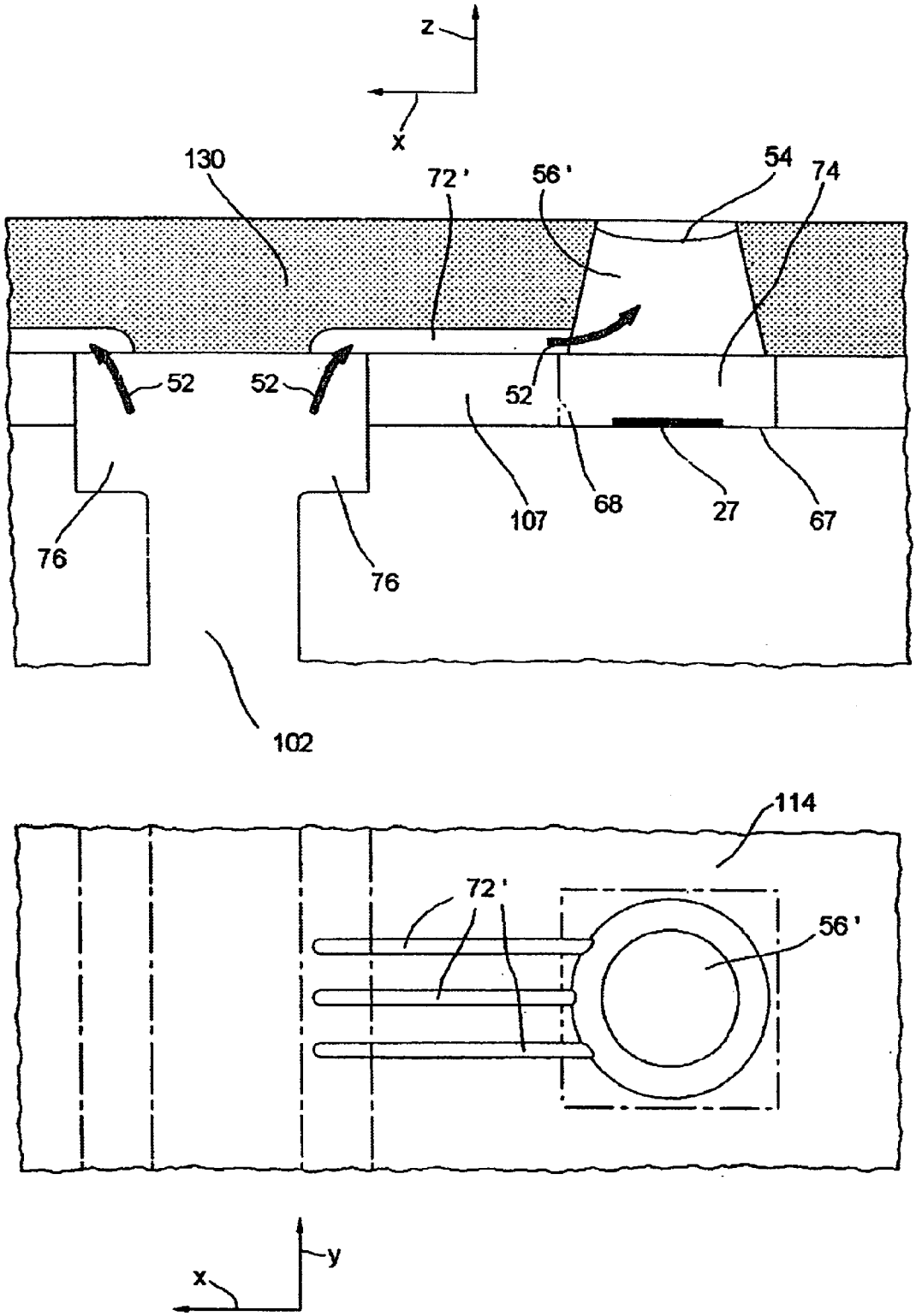
Figure 18:
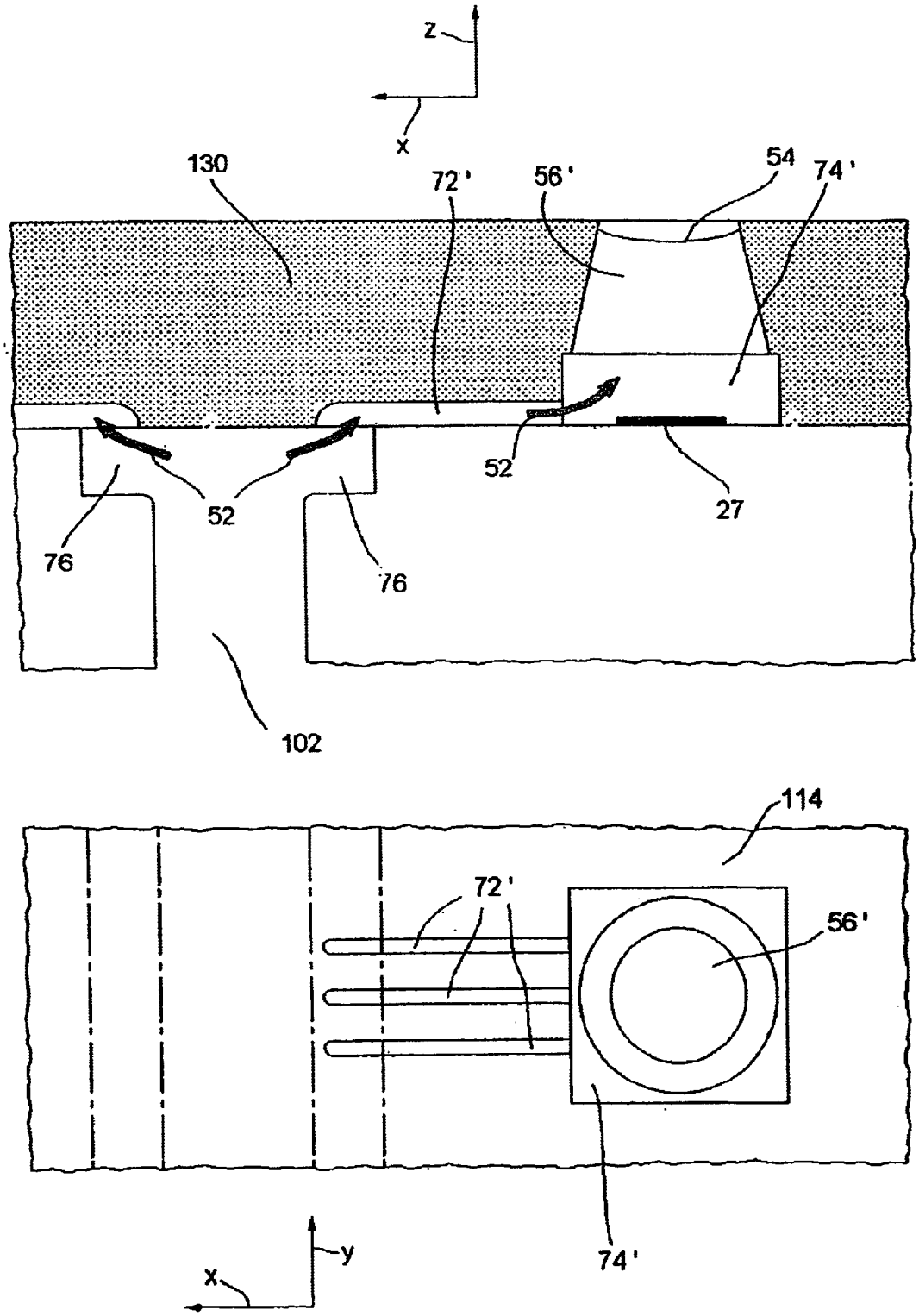
Figure 19:
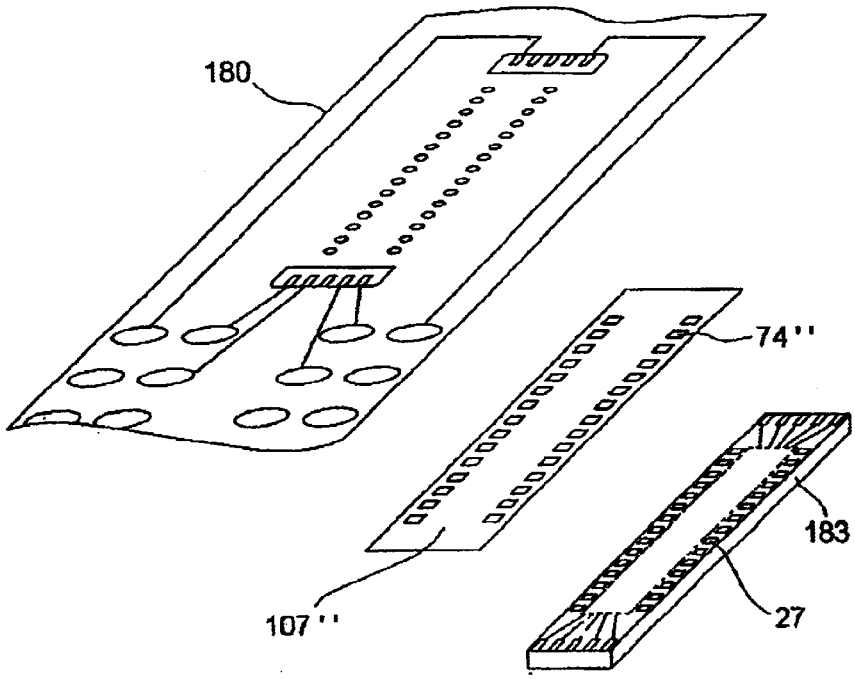
Figure 20:
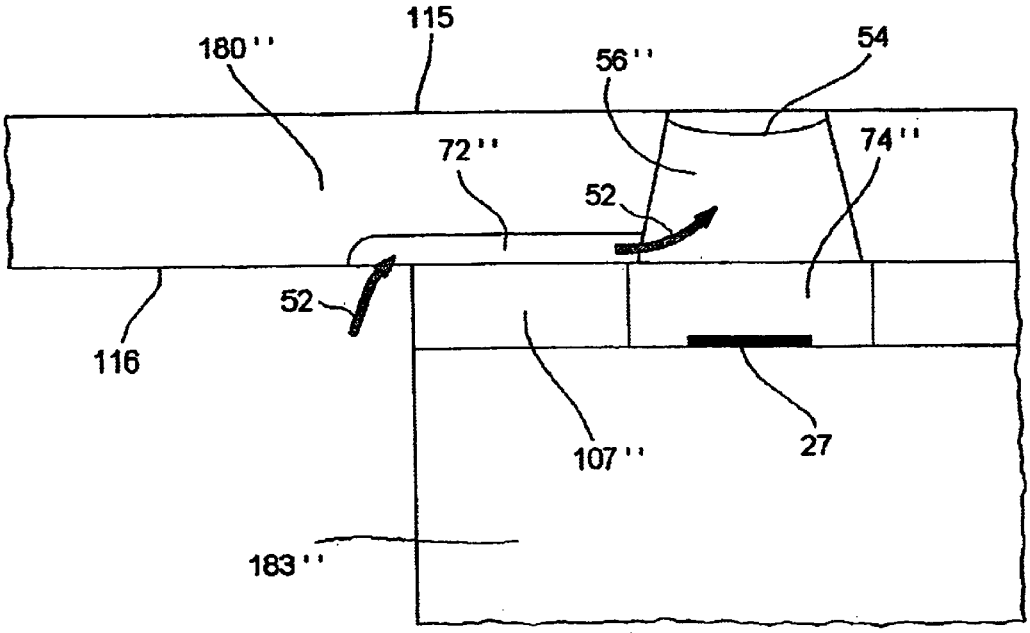

FIGS. from 12 to 14—represent the actuating assembly as it is during later steps of the manufacturing process;

FIG. 15—illustrates the flow of the manufacturing process of an actuating assembly according to a second embodiment;

FIG. 16—represents an enlarged view of an actuating assembly, according to a third embodiment;

FIG. 17—represents a section view and a view of the lower face of the actuating assembly, according to the third embodiment;

FIG. 18—represents section view and a view of the lower face of the actuating assembly, according to a fourth embodiment;

FIG. 19—represents an enlarged view of the actuating assembly, according to a fifth embodiment;

FIG. 20—represents a section view of the actuating assembly, according to the fifth embodiment.

DESCRIPTION OF THE PREFERRED EMBODIMENT

Figure 7:
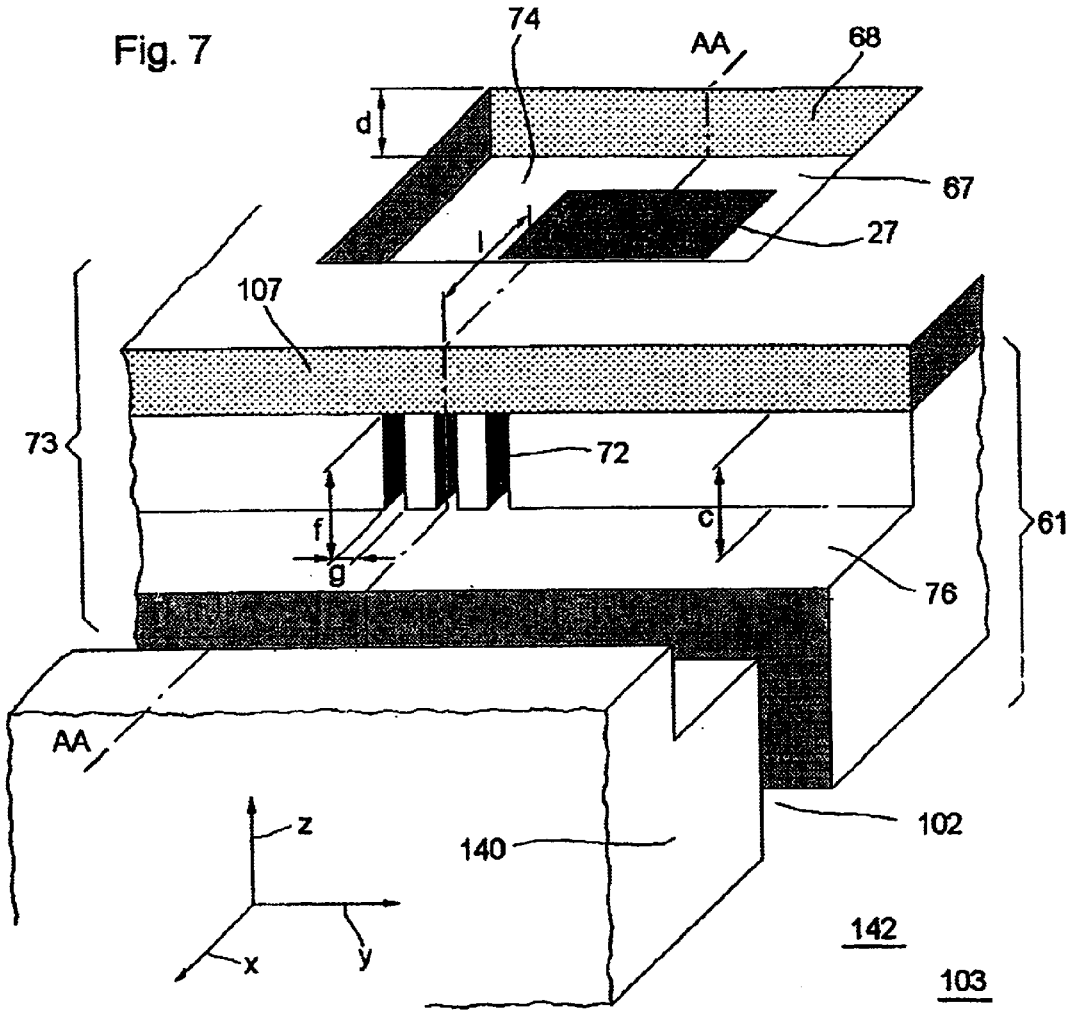
FIG. 7—represents an axonometric view of a portion of the actuating assembly of the head, made according to this invention.

FIG. 7 illustrates a portion of the actuator for printhead, monochromatic or colour, comprising an ejector 73 according to the invention. For simplicity's sake, the other parts of the head, being already known and not concerning the invention, are not depicted. The following are shown in the figure:

- a portion of a die 61;
- a substrate 140 of Silicon P belonging to the die 61;
- a slot 102 cut into the substrate 140;
- the basin 76, having depth c;
- a layer 107 of photopolymer, according to the invention;
- a chamber 74 according to the invention, made in the layer 107 of photopolymer, having depth d;
- a bottom 67 of the chamber 74;
- lateral walls 68 of the chamber 74;
- the resistor 27 on the bottom 67 of the chamber 74;
- elementary ducts 72 according to the invention, which convey the ink 142 from the basin 76 to the chamber 74, each having depth $f$, width g and length l.

Figure 8:
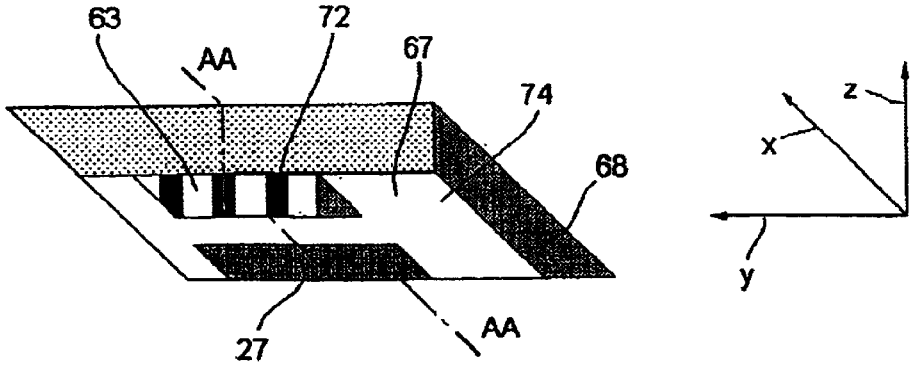
FIG. 8—represents an axonometric view of the emission chamber, according to a different visual angle from that of FIG. 7.

FIG. 8 illustrates the chamber 74 from a different visual angle, indicated by the reference axes, which shows the outlet of the elementary ducts 72 in the chamber 74. The ducts 72 are located under the layer 107 of photopolymer, and are therefore at a lower level than the bottom 67 of the chamber 74: in this way, a tank 63 is made which hydraulically connects the ducts 72 with the chamber 74.

Figure 9:
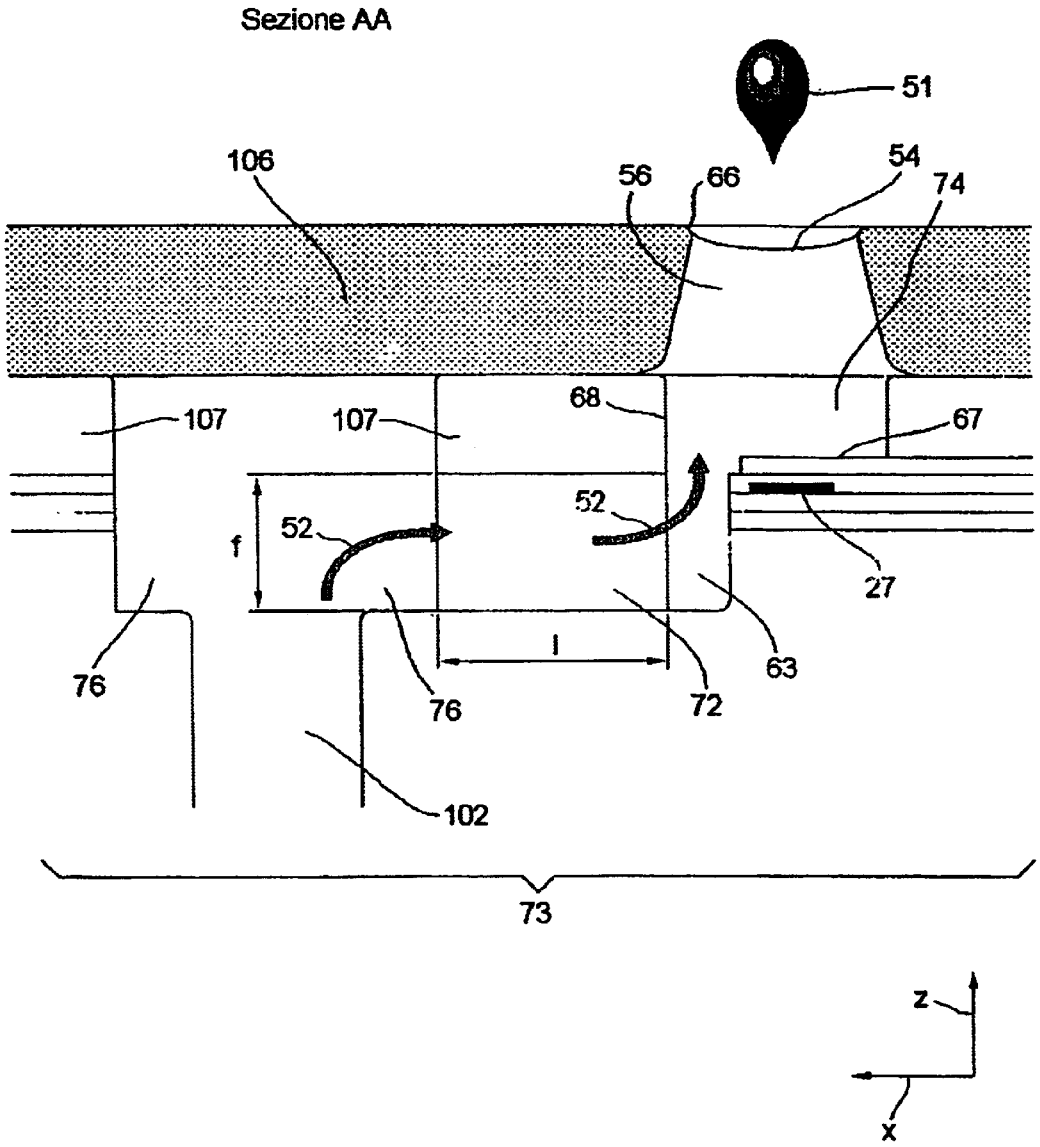
FIG. 9—represents a section according to the plane AA, shown in FIG. 7.

FIG. 9 shows the ejector 73 sectioned according to a plane AA, indicated in FIGS. 7 and 8.

According to a construction variant of the preferred embodiment, the basin 76 is missing, and the ducts 72 face directly on to the slot 102.

A method is now described for calculating the correct number N of elementary ducts 72.

The time constant $\tau$ is a function of the width g of each single duct 72, whereas it is independent of the number N of ducts in parallel, as indicated by the following relation, analogous to (5):

$$\tau = \frac{L}{R} = \frac{g^2}{12 * \upsilon} \tag{6}$$

It is therefore possible to obtain as short a time constant $\tau$ as possible by selecting the smallest value of g possible, compatibly with technological feasibility.

Conversely, if we assign $\tau$ a predetermined value, we obtain:

$$g = \sqrt{12 * \nu * \tau} \tag{7}$$

In practice, the width g according to this invention is, though not exclusively, between 3 and 15 $\mu$m.

Having thus determined the geometrical dimensions of a single duct 72, we obtain values R' and L' of resistance and inductance equivalent to each duct 72 by means of the following relations, similar to (3) and (4):

$$R' \cong \frac{12 * \rho * \upsilon * l}{g^3 * f} \tag{8}$$

$$L' \cong \frac{\rho * l}{g * f} \tag{9}$$

The total resistance R and total inductance L of the equivalent circuit with the plurality of ducts 72 in parallel are calculated using the known formula for impedances in parallel, and are:

$$R = R'/N \tag{10}$$

$$L=L'/N \tag{11}$$

It is now possible to obtain the value of N by substituting the expressions (10) and (11) in (2), which becomes:

$$\frac{R'}{N} = 2 * \sqrt{\frac{L'}{N * C_m}} \tag{12}$$

and which allows us to obtain $$N = (R')^2 * \frac{C_m}{4L'} \tag{13}$$

The value thus obtained for N is generally not an integer, and must be rounded to the nearest whole number: this causes a slight deviation from the condition of critical damping, which may be recovered with a slight variation of the length l of the elementary duct 72.

Figure 10:
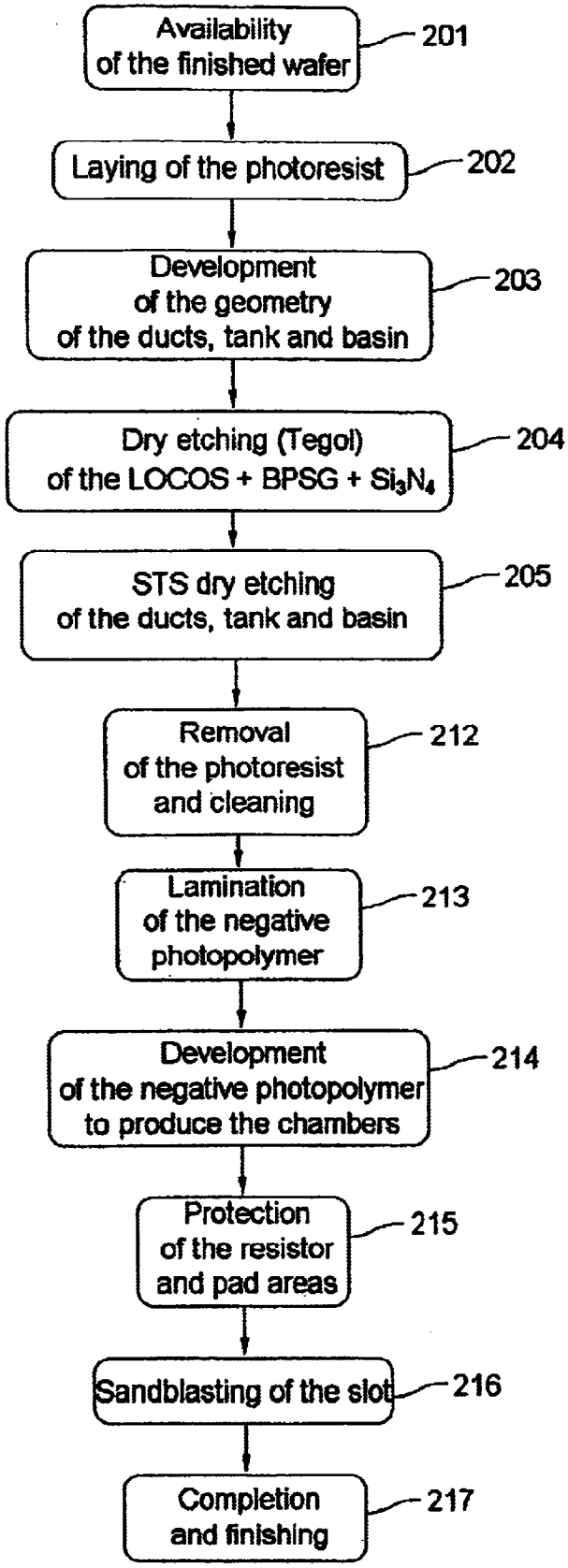
FIG. 10—illustrates the flow of the process for manufacture of the actuating assembly of FIG. 7.

The manufacturing process of an ejector 73 for a monochromatic or colour ink jet printhead 40 according to the invention is effected according to the steps indicated in the flow diagram of FIG. 10. FIGS. 11 to 14 represent the ejector 73 in successive stages of the work.

Figure 11:
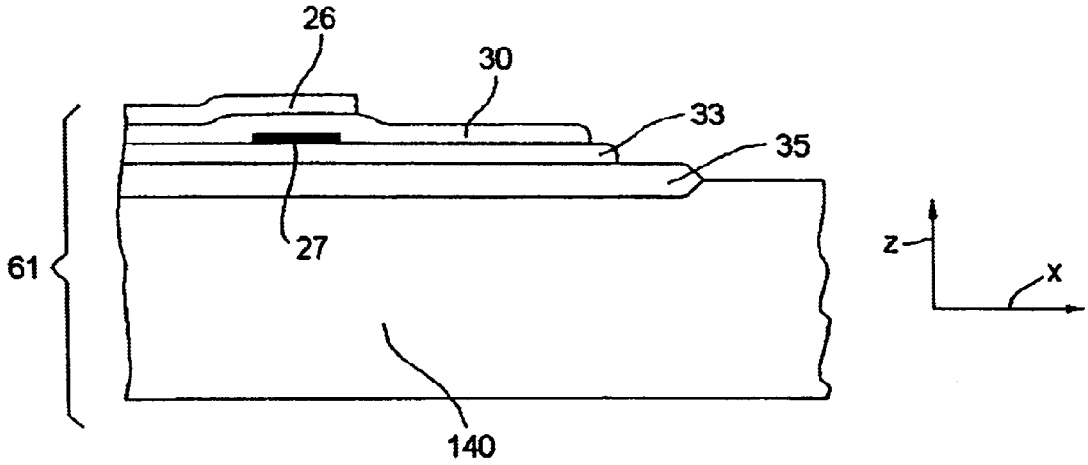
FIG. 11—represents a section view of the actuating assembly, at the start of the manufacturing process.

In the step 201, by means of a known process, a wafer is made available containing a plurality of dice completed solely in the control circuits 62 and in the resistors 27. Visible in FIG. 11 is a section of a portion of a die 61 in which an ejector will be made. The following are indicated:

- a portion of the die 61;
- the substrate 140 of Silicon P belonging to the die 61;
- a LOCOS insulating layer 35 Of $SiO_2$;
- a BPSG "interlayer" 33;
- the resistor 27;
- a layer 30 Of $Si_3N_4$ and SiC for protection of the resistors;
- a conducting layer 26, made of a layer of Tantalum covered by a layer of Gold.

In the step 202, a photoresist is laid over the entire surface of the wafer.

In the step 203, development is effected of the photoresist, by means of a first mask not depicted in any of the figures, of the geometry of the elementary ducts 72, of the basin 76 and of the tank 63.

In the step 204, dry etching (Tegol) is performed of the LOCOS+BPSG+$Si_3N_4$ until the substrate 140 of Silicon is uncovered in the areas defined by the first mask in the previous step 203.

Figure 12:
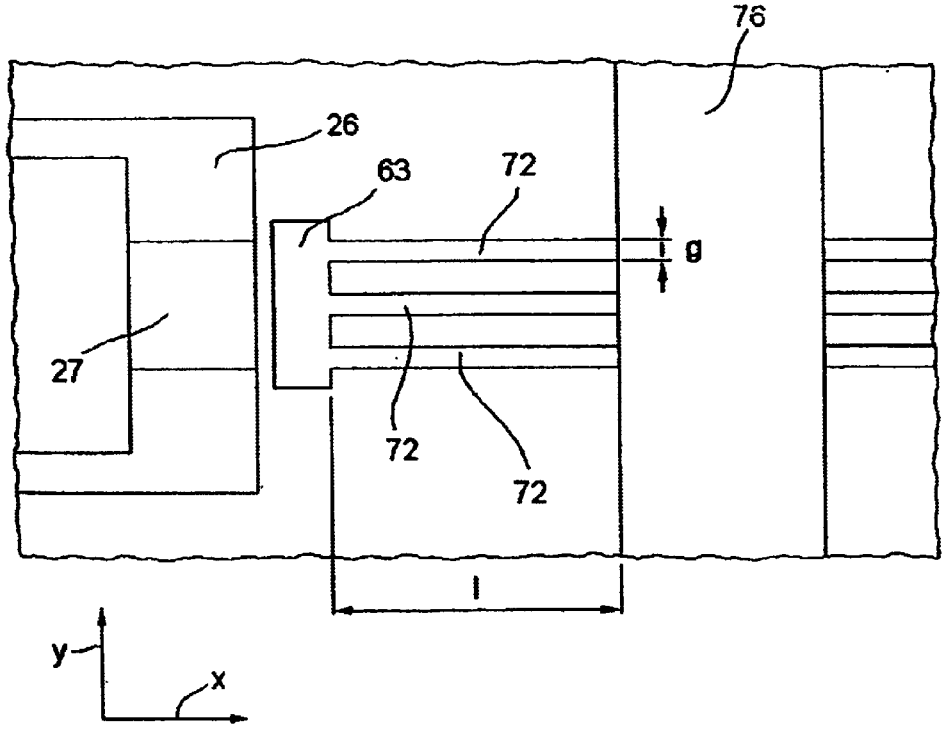

In the step 205, the elementary ducts 72, the basin 76 and the tank 63 are etched into the Silicon using "dry" technology in the STS plant, with arrangements known to those acquainted with the sector art. Geometry of the etching is defined by the photoresist already developed in the step 203 according to the design of the first mask, reinforced by the layer of LOCOS+BPSG +$Si_3N_4$ beneath. Referring back to FIG. 7, depth *f* of the channels is less than depth c of the basin 76 due to the different etching speed resultant on the different width of the etching front. If, as a non-restricting example, we assume *f*=10 $\mu$m, g=5 $\mu$m and a basin width of 300 $\mu$m we obtain a depth c of the basin equal to approximately 20 $\mu$m. In general, the depth *f* is prevalently but not exclusively between 10 and 100 $\mu$m. At this stage of the work, the ejector is as shown in FIG. 12.

In the step 212, the photoresist is removed and the wafer cleaned.

In the step 213, the layer 107, consisting of negative photopolymer, is laminated on the entire surface of the wafer.

Figure 13:
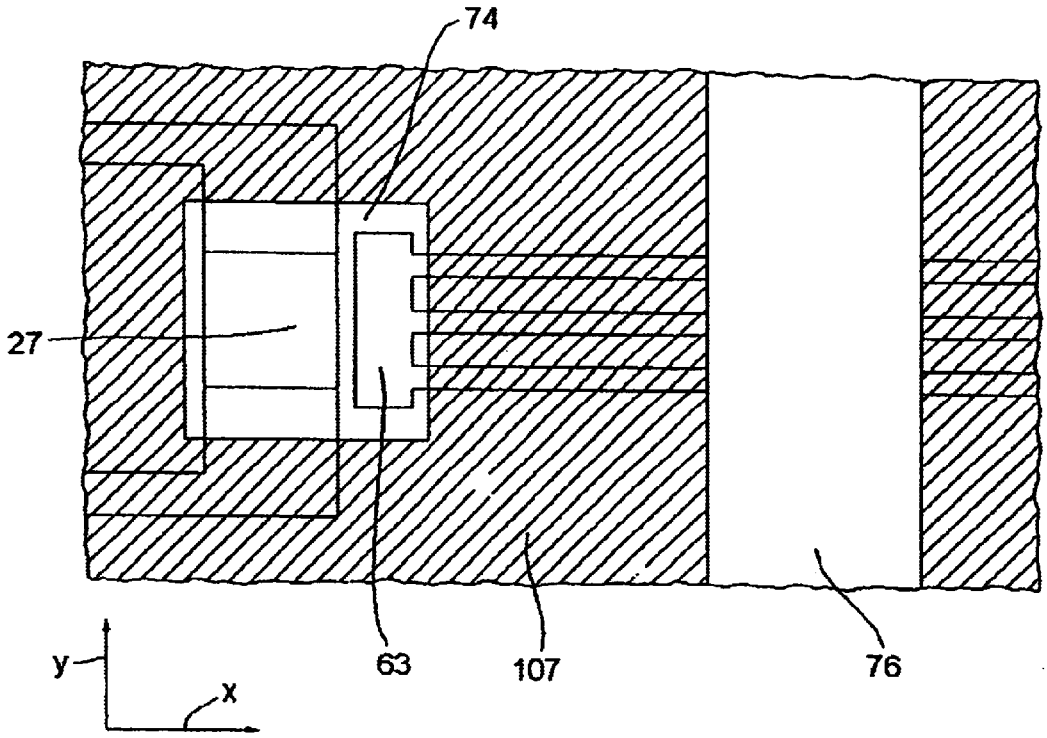

In the step 214, the layer 107 is developed according to the geometry of a second mask, non depicted in any of the figures, with the purpose of obtaining the chamber 74, the plan of which includes the resistor 27 and the tank 63, and uncovering the basin 76, as illustrated in FIG. 13, where the dashed area represents the remaining photopolymer.

In the step 215, the areas of the resistors 27 and of the soldering pads 77 are protected using a material that may be removed with water.

Figure 14:
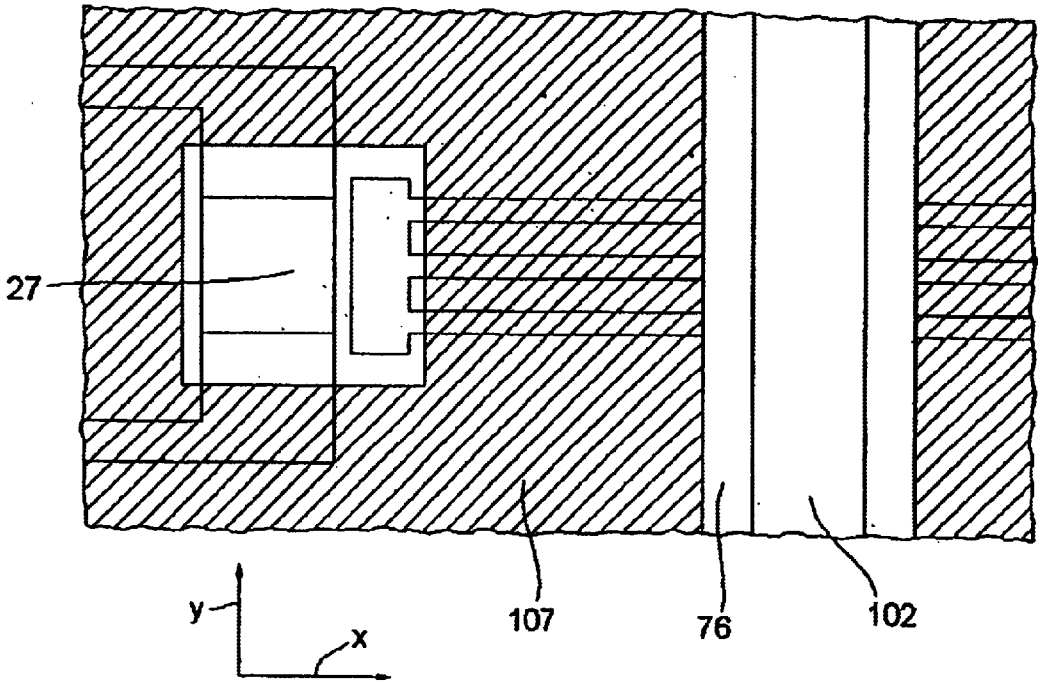

In the step 216, the pass-through slot 102 is made by way of, for example, a sand blasting process. At this stage of the work, the zone of the ejector is as shown in FIG. 14.

In the step 217, the usual completion and finishing operations are carried out, known to those acquainted with the sector art.

Second Embodiment

The principle of the invention is also applicable in cases where the basin 76 is made with a ratio between the depth c and the depth *f* of the elementary ducts 72 and of the tank 63 that is greater than what it would be naturally on account of the different etching speeds. As a non-restricting example, for the basin 76 a depth c of between 20 and 100 $\mu$m may be selected, and for the ducts 72 and the tank 63 a depth *f* of between 5 and 20 $\mu$m. The production process is modified according to the flow diagram of FIG. 15, in which the following steps are inserted after the step 204.

In the step 205', elementary ducts 72 and the tank 63 are etched into the Silicon with "dry" technology on the STS plant. The depth *f* of the etching is prevalently but not exclusively limited to between 5 and 20 $\mu$m. In this stage, the basin 76 may or may not be etched, depending on the design of the first mask.

In the step 206, the photoresist previously laid in the step 202 and developed in the 203 is removed.

In the step 207, lamination is performed of a "dry film" type photoresist over the entire surface of the wafer, which in this way covers and protects the area occupied by the ducts 72 and the tank 63.

In the step 210, development is effected of the second photoresist, by means of a third mask not depicted in any of the figures, so as to leave uncovered only the area of the basin 76.

In the step 211, a further etching is made in the Silicon, this time of the basin 76, using "dry" technology in the STS plant. The depth of this etching is in this way greater than that which would be obtained by the step 205' alone, and prevalently but not exclusively between 20 and 100 $\mu$m.

Once this step is completed, the process continues to step 212, as already described for the preferred embodiment.

Third Embodiment

Figure 1:
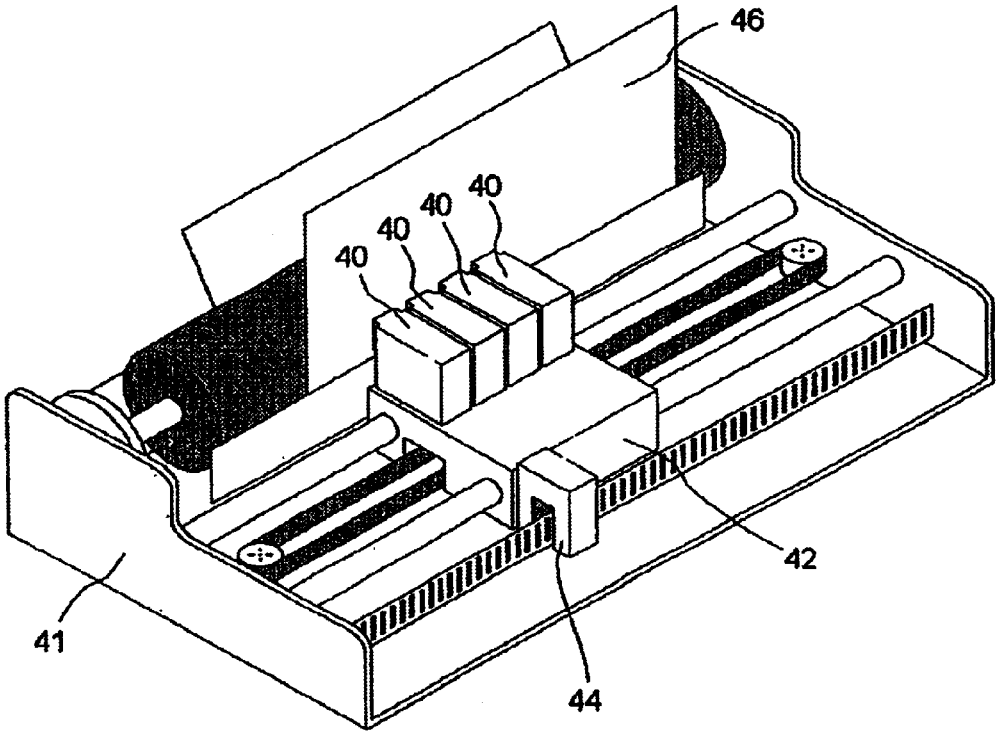
FIG. 1—is an axonometric view of an ink jet printer.
Figure 1:
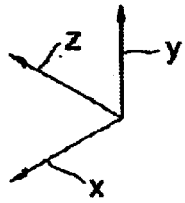
Figure 2:
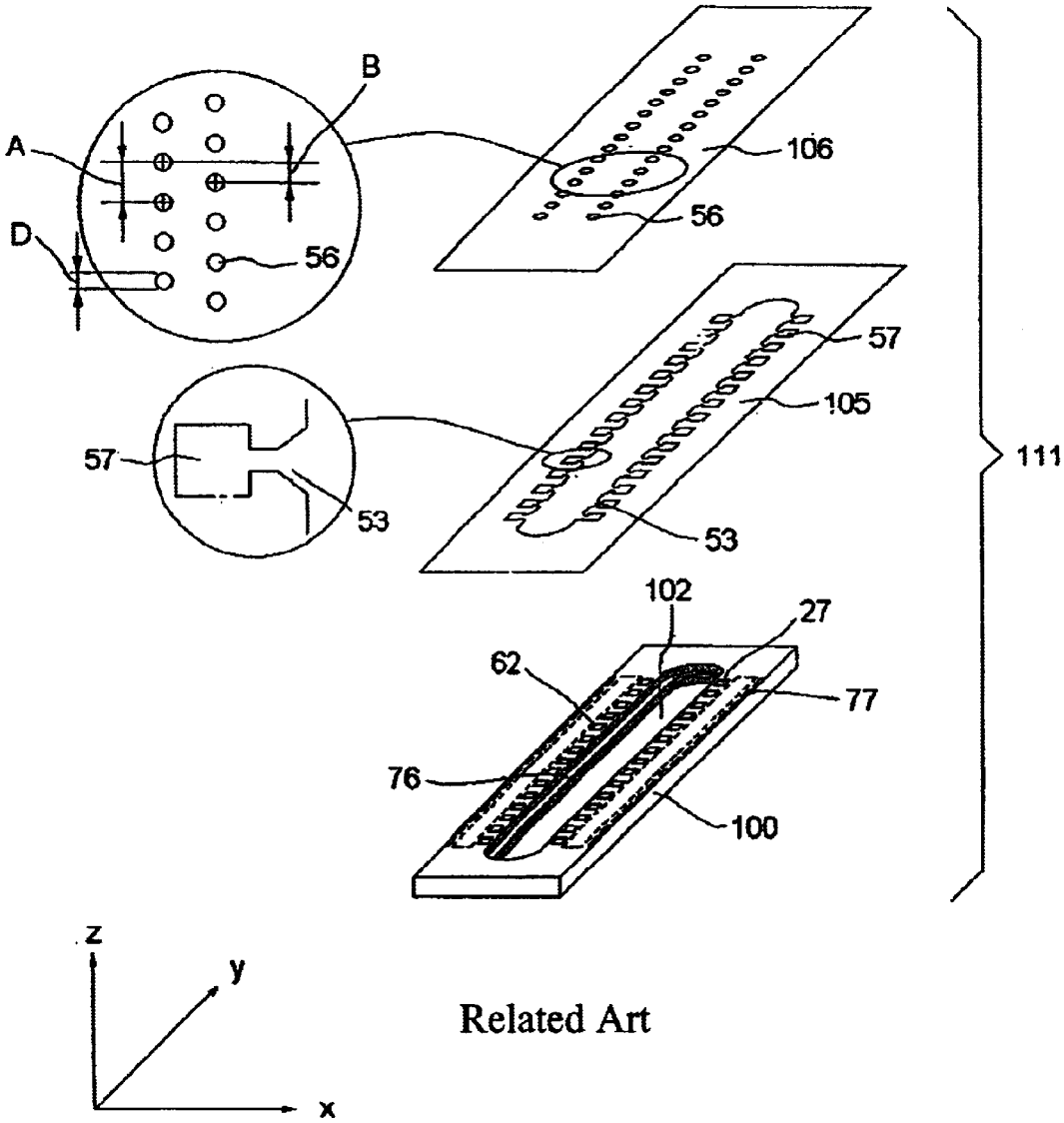
FIG. 2—is an enlarged view of an actuating assembly made according to the known art.
Figure 3:
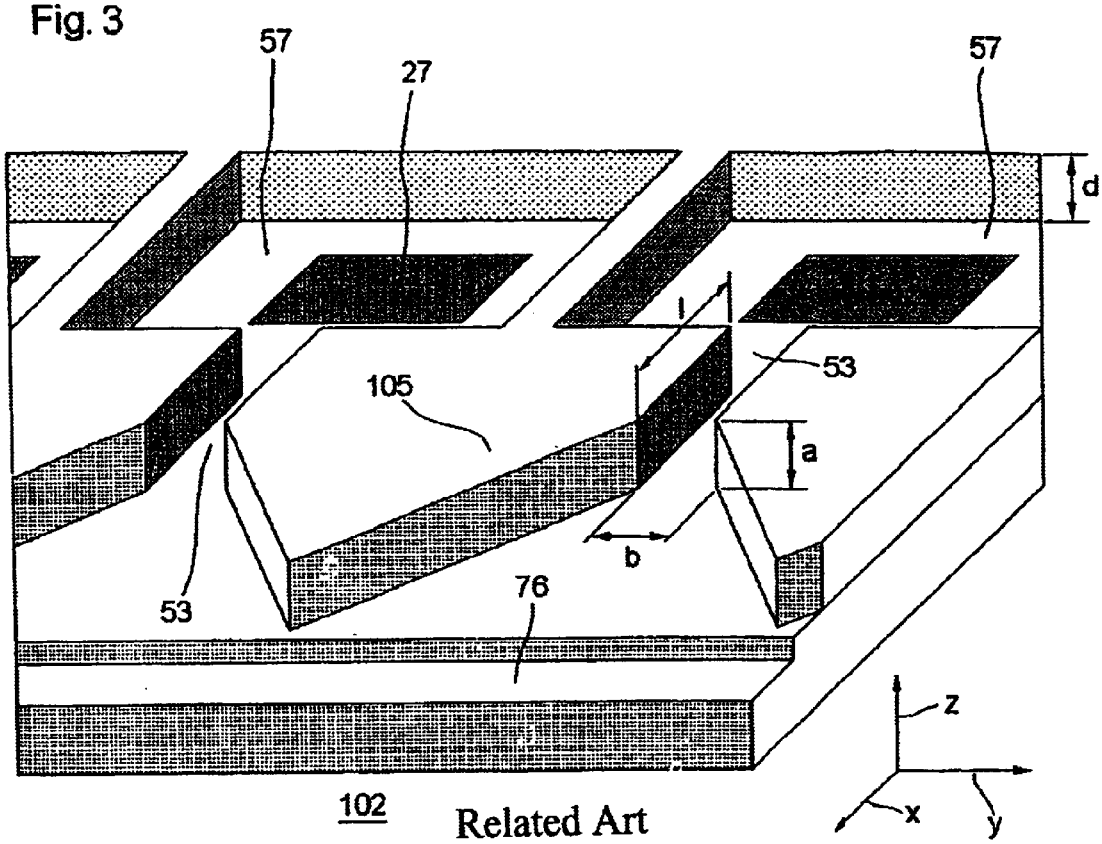
FIG. 3—represents two emission chambers, according to the known art.
Figure 4:
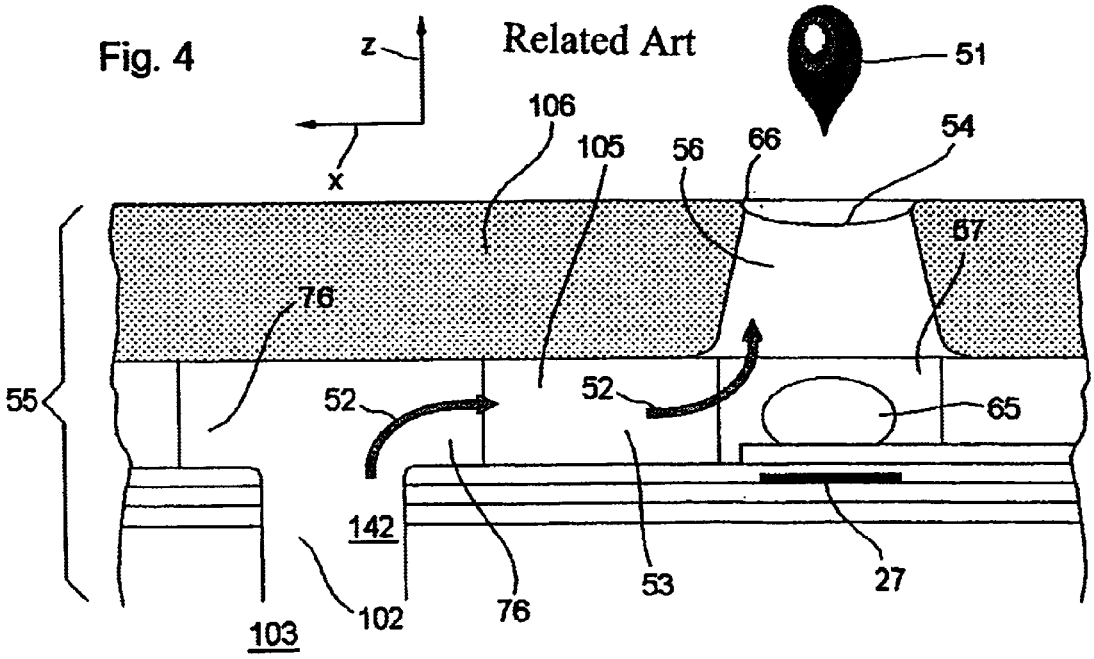
Related Art Fig. 4
FIG. 4—represents a sectioned view of one ejector of the head, according to the known art.
Figure 5:
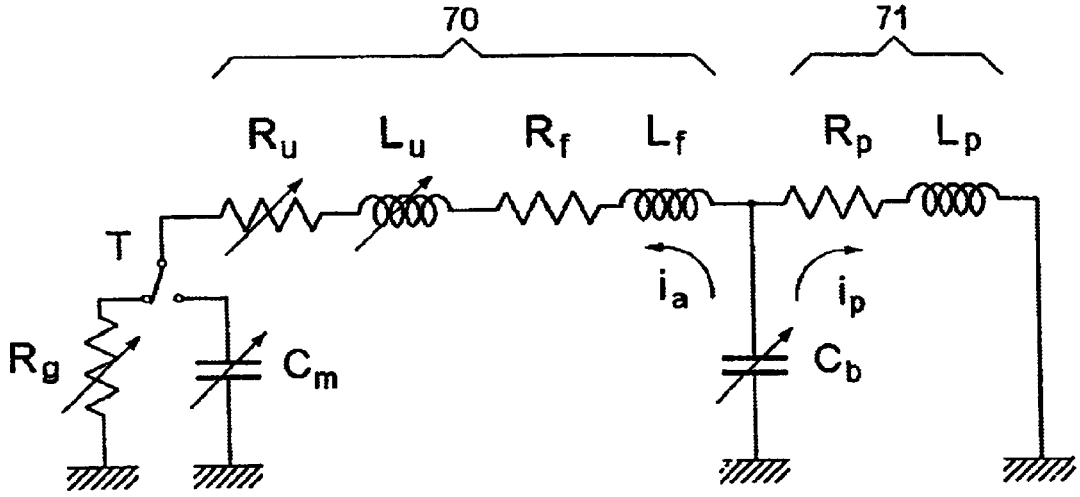
FIG. 5—represents an equivalent electrical diagram of the hydraulic circuit of an ejector of the head.
Figure 6:
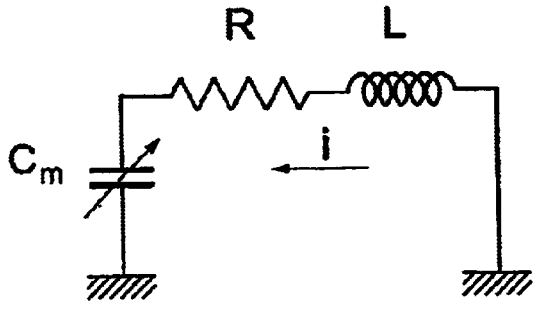
FIG. 6—represents a simplified equivalent wiring diagram of the hydraulic circuit of an ejector of the head.

A variant in the known art consists in producing the nozzles directly on a "flat cable", which in this way also performs the function of nozzle plate, and is represented in FIG. 16 by means of an enlarged view of an actuating assembly 112. According to this embodiment, the nozzle plate 106 is replaced by a flat cable with nozzles 130, which comprises the nozzles 56'. The following may be seen in the figure:

- the die 100, made according to the known art already illustrated in FIG. 2;
- the layer of photopolymer 107, made according to the preferred embodiment, which comprises the chambers 74 having the continuous lateral walls 68;
- the flat cable with nozzles 130, made for instance of Kapton;
- an upper face 113 of the flat cable with nozzles 130;
- a lower face 114 of the flat cable with nozzles 130.

FIG. 17 presents a section of the flat cable with nozzles 130 and a view of its lower face 114, limited to a single ejector. The elementary ducts 72' are made directly on the lower face 114 of the flat cable with nozzles 130, using for instance an excimer laser.

Fourth Embodiment

This embodiment is represented in FIG. 18 by way of a section of the flat cable with nozzles 130 and a view of the lower face 114, limited to a single ejector. The elementary ducts 72' are again made directly on the lower face 114 of the flat cable with nozzles 130, together with a chamber 74', using for instance an excimer laser, but the layer 107 is missing.

Fifth Embodiment

The principle of the invention is also applicable in cases where the feeding of the ink takes place on the two sides of the die, according to a variant of the known art disclosed in the U.S. Pat. No. 5,278,584. FIG. 19 represents a die 183 with lateral feeding of the ink and a flat cable with nozzles 180 associated therewith, having an upper face 115 and a lower face 116, produced according to said patent.

FIG. 20 represents a section view of a die with lateral feeding 183", of a photopolymer 107" in which a plurality of chambers 74" has been made, of a flat cable with nozzles 180" which present an upper face 115 and a lower face 116. A plurality of nozzles 56" and elementary ducts 72" are made in the lower face 116 of the flat cable with nozzles 180", similarly to what was described in the third embodiment. The ink reaches the chamber 74" from the sides of the dice 183" through the elementary ducts 72".

A variant of the fifth embodiment may be obtained by also etching the chambers directly in the lower face 116 of the flat cable with nozzles 180" and eliminating the layer of photopolymer 107", similarly to what was described for the fourth embodiment.

A further variant of the fifth embodiment may be obtained by etching the elementary ducts in the silicon of the dice 183, on a plane below the layer 107", similarly to what was described for the preferred embodiment. The elementary ducts face on to a depression produced by a "scribing" operation, known to those acquainted with the sector art: in this way, the cut with the diamond wheel, which separates the dice 183, does not touch the ends of the elementary ducts directly, and thus avoids damaging them.

What is claimed is:

1. Method for manufacturing a thermal ink jet printhead (40) comprising a reservoir (103) suitable for containing ink, a die (61), a slot (102) etched into said die (61) and a plurality of ejectors (73), each of which in turn comprises a chamber (74), a resistor (27) and a nozzle (56), characterized in that it comprises the steps of:

(205) etching a plurality of elementary ducts (72), a tank (63) and a basin (76) fluidly connected with said slot (102);

(213) covering said plurality of elementary ducts (72) and said tank (63) by means of a layer (107); and

(214) producing in said layer (107) said chamber (74), fluidly connected with said plurality of elementary ducts (72) and with said tank (63).

2. Method according to claim 1, characterized in that it also comprises the step of:

(211) effecting a further etching of the basin (76).

* * * * *